US008979680B2

(12) United States Patent
Hudack, III

(10) Patent No.: US 8,979,680 B2
(45) Date of Patent: Mar. 17, 2015

(54) SURFACE MARKING SYSTEM FOR COMPETITIVE THROWING AND TRAINING

(75) Inventor: Lawrence Joseph Hudack, III, Corona, CA (US)

(73) Assignees: Lawrence Joseph (Joey) Hudack, III, Corona, CA (US); Dawn R. Hudack, Corona, CA (US)

( * ) Notice: Subject to any disclaimer, the term of this patent is extended or adjusted under 35 U.S.C. 154(b) by 12 days.

(21) Appl. No.: 13/585,845

(22) Filed: Aug. 15, 2012

(65) Prior Publication Data

US 2013/0085019 A1 Apr. 4, 2013

Related U.S. Application Data

(60) Provisional application No. 61/540,540, filed on Sep. 29, 2011.

(51) Int. Cl.

| | |
|---|---|
| ***A63B 67/00*** | (2006.01) |
| ***A63B 67/06*** | (2006.01) |
| ***A63B 65/06*** | (2006.01) |
| ***A63B 65/02*** | (2006.01) |
| ***A63B 65/10*** | (2006.01) |
| ***A63B 71/06*** | (2006.01) |
| *A63B 24/00* | (2006.01) |

(52) U.S. Cl.

CPC ..... *A63B 65/02* (2013.01); *A63B 65/06* (2013.01); *A63B 2024/005* (2013.01); *A63B 65/10* (2013.01); *A63B 67/00* (2013.01); *A63B 2024/0043* (2013.01); *A63B 71/0608* (2013.01)

USPC ..... 473/415; 473/588

(58) Field of Classification Search

CPC ..... A63B 65/02; A63B 65/04; A63B 65/10; A63B 67/00; A63B 67/06

USPC ..... 473/422, 237, 280, 577, 570, 585–589; 273/349, 378; 482/20–22

See application file for complete search history.

(56) References Cited

U.S. PATENT DOCUMENTS

| | | | | | |
|---|---|---|---|---|---|
| 3,081,091 | A | * | 3/1963 | Grow | 473/280 |
| 3,190,654 | A | * | 6/1965 | Ross | 473/577 |
| 3,759,513 | A | * | 9/1973 | Gillett | 482/22 |
| 4,065,126 | A | | 12/1977 | Mantz | |
| 4,183,536 | A | * | 1/1980 | Platt | 473/570 |
| 4,596,392 | A | | 6/1986 | Walker | |
| 4,637,616 | A | * | 1/1987 | Whiting | 473/577 |
| 4,830,370 | A | * | 5/1989 | Schlesinger | 473/577 |
| 4,886,275 | A | | 12/1989 | Walker | |
| 5,018,450 | A | | 5/1991 | Smith | |
| 5,121,692 | A | | 6/1992 | DiCarlo | |
| 5,277,641 | A | * | 1/1994 | Gable et al. | 473/594 |
| 5,522,780 | A | * | 6/1996 | Roddy | 482/21 |
| 6,073,588 | A | * | 6/2000 | McClung et al. | 119/709 |
| 6,378,439 | B1 | | 4/2002 | Saxby | |
| 6,619,211 | B1 | | 9/2003 | Haeselich | |
| 6,714,284 | B2 | | 3/2004 | Norman | |
| 6,726,584 | B2 | | 4/2004 | Iggulden | |
| 7,399,234 | B2 | | 7/2008 | Geraty | |
| RE40,482 | E | | 9/2008 | Haeselich | |
| 7,475,638 | B2 | | 1/2009 | Haeselich | |
| 7,604,556 | B2 | | 10/2009 | Witzigreuter | |
| 2013/0085019 | A1 | * | 4/2013 | Hudack, III | 473/415 |

* cited by examiner

*Primary Examiner* — Mitra Aryanpour

(57) ABSTRACT

A marking system for use with competitively thrown objects such as discuses, shot puts, hammers and javelins. The marking system has a cavity which contains a marking agent which is automatically deposited from the cavity onto the ground when the thrown object hits the ground. Other embodiments are describes and shown.

15 Claims, 4 Drawing Sheets

SURFACE MARKING SYSTEM FOR COMPETITIVE THROWING AND TRAINING

CROSS-REFERENCE TO RELATED APPLICATIONS

This application claims the benefit of provisional patent application Ser. No. 61/540,540 filed 1901 Jan. 1 by the present inventor.

FEDERALLY SPONSORED RESEARCH

None

SEQUENCE LISTING

None

FIELD OF THE INVENTION

The present invention relates to a system and method for determining the point of impact of a object.

BACKGROUND OF THE INVENTION

Track and field athletes participating in throwing events such as discus throw, hammer throw, javelin throw, and shot put compete by throwing objects as far as they can in a desired direction. In such a throwing event, particularly one with small variations between the performances of the competitors, there is a desire for maximal accuracy, precision, efficiency and accountability in methods of determining the point of impact of the thrown objects.

Currently, at many levels of competition, the distance travelled of a thrown object is measured between a reference thrower position and a spotter marked point. The spotter marked point being determined by visual spotting by a spotter of the impact of the thrown object with the ground and placement of a marker by the spotter at the spotted point of impact. The performance of this spot and mark measurement method is limited by the ability of the spotter to accurately, precisely, efficiently, and accountably mark the point of impact while maintaining the safety of the spotter.

Currently, when a throwing competitor wishes to train at its event(s), it is reliant upon a spotter to help it determine the length of its throws. Without the help of a spotter the thrower has great difficulty in efficiently evaluating the caliber of each of its throws.

Efficient and reliable determination of the point of impact can be made further difficult by other aspects of the throwing event. Many throwing events are held on modern synthetic playfields on which thrown objects may leave little physical marks on the playfield surface. The location of spotter marks may be perturbed by further throws into the same space. The spotters and throwers must also be careful to ensure that the safety of the spotter is maintained during the spotting process.

It will be appreciated that there is a need for improvement from the spot and mark method in throwing competitions inside and outside of the sport of track and field as well as in other systems in which a point of impact of one object with another is to be determined accurately, precisely, efficiently and accountably.

SUMMARY OF THE INVENTION

In accordance with one embodiment a first object capable of being thrown, launched, projected or otherwise caused to impact (hereinafter thrown) a second object, has one or more cavities for storing a marking agent and a marking agent within the one or more cavities; the cavities having an orifice through which the marking agent may pass and be deposited onto the second object upon impact of the first object with the second object.

One object of the present invention is to provide a system by the use of which the point of impact of a first object with a second object can be accurately, precisely, efficiently, durably, safely, and accountably marked on the second object by a marking agent born with the first object. Another object of the invention is to provide a marking agent delivery mechanism which may be implemented with various impacting objects including but not limited to discuses, shot puts, hammers and javelins. Another object of the invention is to be capable of being implemented in multiple fashions with each impacting object, including but not limited to centrally, radially, and circumferentially. Yet another object of the invention is to permit the use of varying marking agents so as to permit specific choice of marking agent to suit the marking object, to suit the object to be marked, to indicate an aspect of the thrower, and/or for aesthetic or other purposes.

Accordingly several advantages of one or more aspects are as follows: to provide a means of accurately, precisely, efficiently, durably, safely and accountably marking the point of impact of the object. Other advantages of one or more aspects will be apparent from a consideration of the drawings and ensuing description.

REFERENCE NUMERALS

Figure 1:
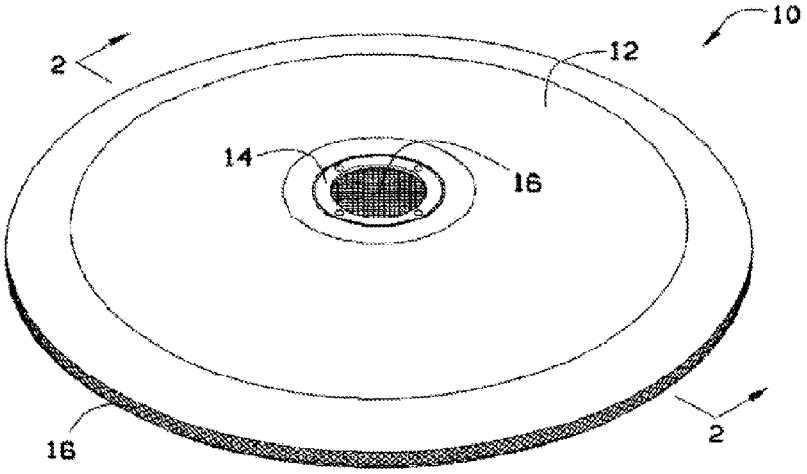
FIG. 1 is a perspective view of a discus embodiment of an aspect of the invention.

10 thrown object
12 discus
14 cap
16 screen
18 marking material cavity
20 shot put
22 filler plug
24 javelin
26 filler plug
28 marking material
30 marking material pouch top
32 marking material pouch body
34 twist cap removal tool teeth
36 twist cap removal tool handle
38 pouch
40 cap removal tool
42 cap removal tool insert holes

DETAILED DESCRIPTION OF THE PREFERRED EMBODIMENTS

Reference is now made to the figures wherein like parts are designated with like numerals throughout.

Figure 2:
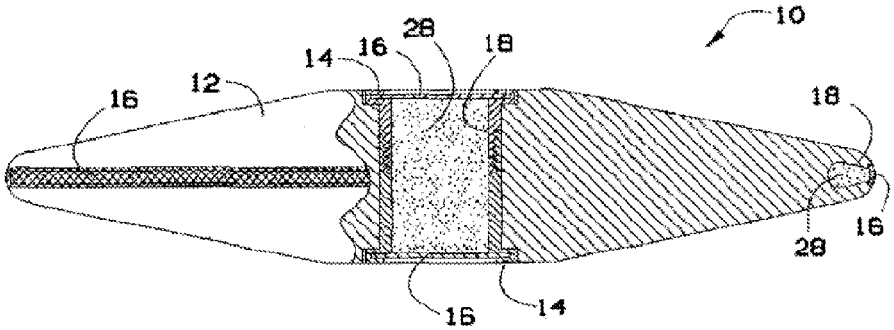
FIG. 2 is a partial section view of the discus of FIG. 1 taken along line 2-2.
Figure 3:
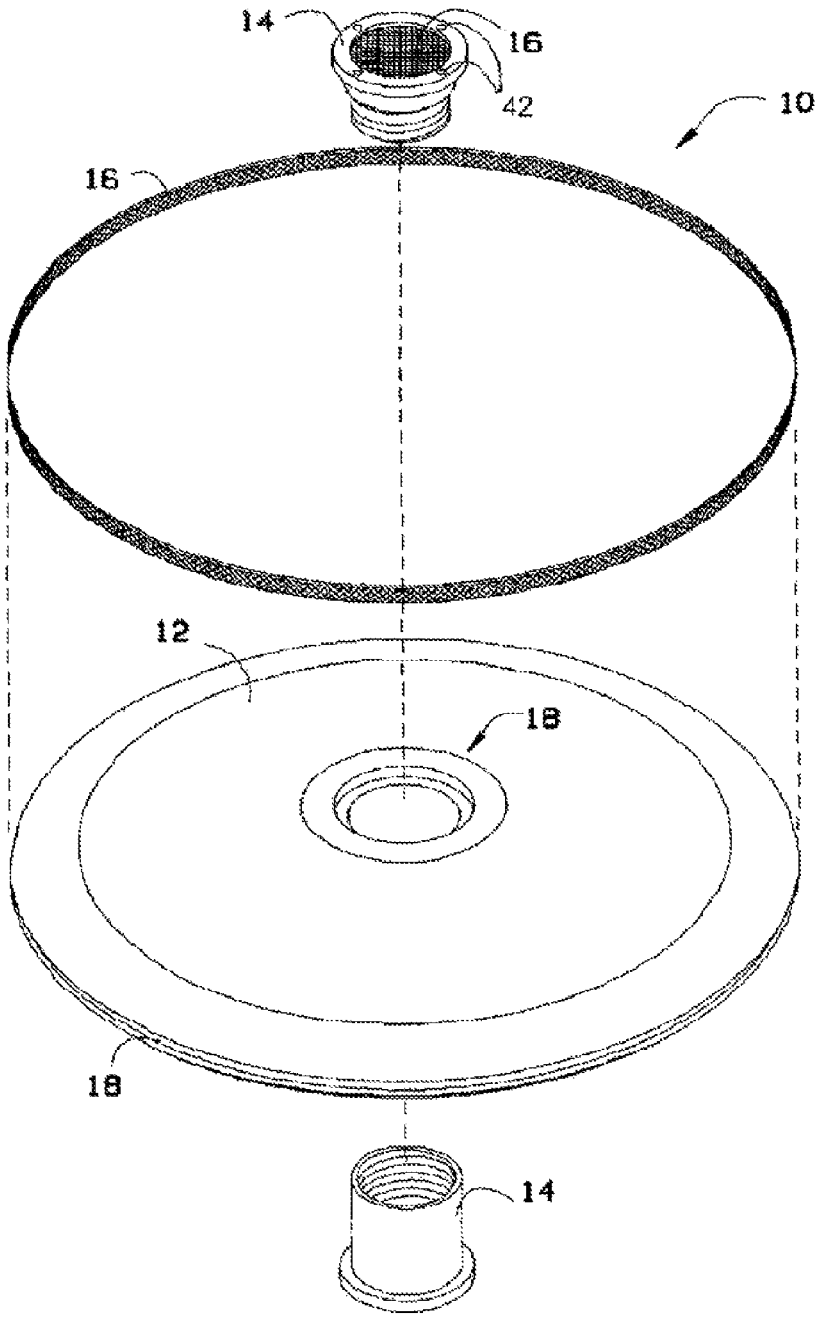
FIG. 3 is an exploded view of the discus of FIG. 1.

In one embodiment (FIGS. 1-3) the thrown object 10 is a substantially lenticular disc or discus 12 comprising one or more cavities 18. The cavities 18 may alternatively be circumferential or central to the object 10.

Figure 4:
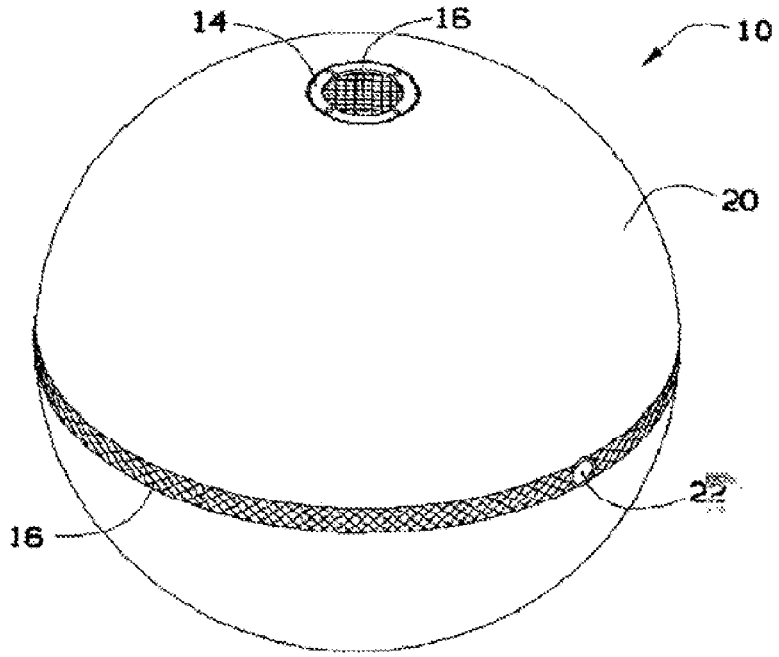
FIG. 4 is perspective view of an alternate shot put embodiment of an aspect of the invention.

In another embodiment (FIG. 4) the thrown object 10 is substantially spherical 20 comprises one or more cavities 18. The cavities 18 may alternatively be radial or circumferential to the object. The object may alternatively comprise an attached rigid or flexible handle.

Figure 5:
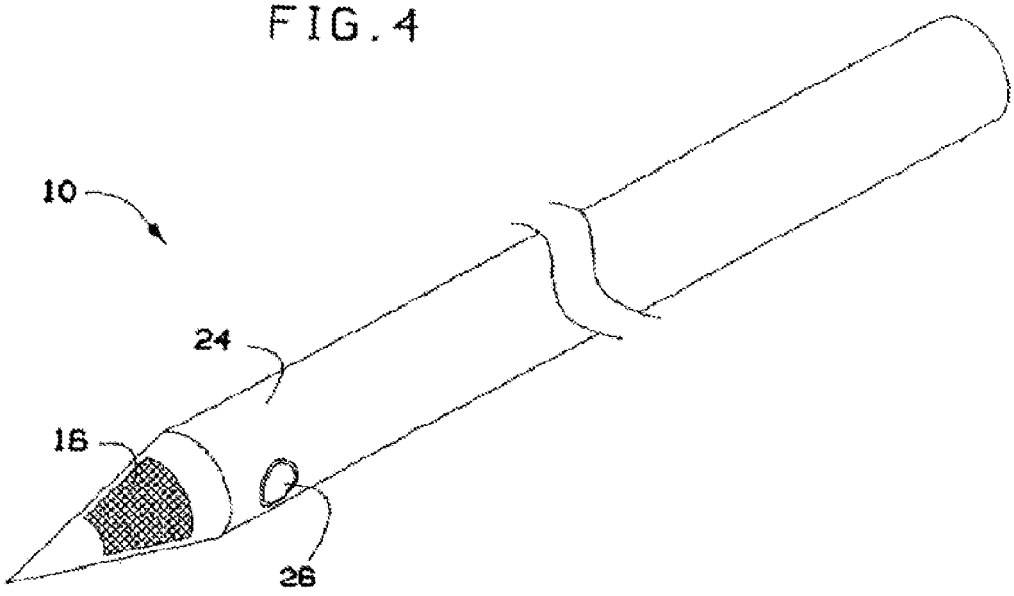
FIG. 5 is perspective view of an alternate javelin embodiment of an aspect of the invention.

In yet another embodiment (FIG. 5) the thrown object 10 is an elongated shaft 24 having an end suitable for impacting a second object. The elongated shaft may comprise one or more cavities 18 within the impact suitable end.

Each cavity 18 is capable of containing a marking agent 28 and is externally communicable with the periphery of the object through one or more orifices of the cavity 18. Alternatively, each cavity 18 may be capable of accepting one or more reservoirs capable of containing the marking agent 28. The one or more reservoirs are capable of being removably or irremovably affixed to the object 10. The one or more reservoirs are also externally communicable with the periphery the object 10 through the orifices of the one or more cavities 18 that they occupy.

Each orifice of each cavity 18 and each reservoir is capable of being removably and irremovably capped by permeable and impermeable caps 14, 22, and 26. The impermeable caps 22 and 26 are capable of preventing the marking agent 28 from leaving the cavities 18 or reservoirs through the orifices of the reservoirs or cavities 18 that they cap. The permeable caps 14 are also capable of preventing the marking agent 28 from leaving the reservoirs or cavities 18 that they cap. The permeable caps 14 are additionally capable of permitting the passing of the marking agent 28 through one or more of the reservoir and/or cavity 18 orifices, out of the object 10 and onto a second object onto which the thrown object 10 has impacted. Transmittal of the marking agent 28 through the permeable caps 14 may be by means of a screen 16. The one or more removable caps 14, 22, and 26 may have cap removal tool insert holes 42 with which the cap removal tool teeth 34 of cap removal tool 40 can engage to facilitate removal of the one or more caps by manipulation of the cap removal tool handle 36.

In another embodiment one or more caps 14 and or one or more screens 16 may be integral to the thrown object 10.

Figure 6:
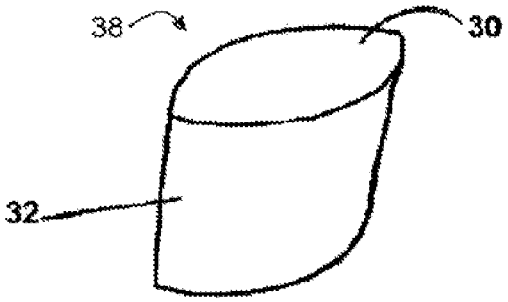
FIG. 6 is a perspective view of a pouch/bag which may contain the marking agent for easy insertion into the thrown object 10.
Figure 7:
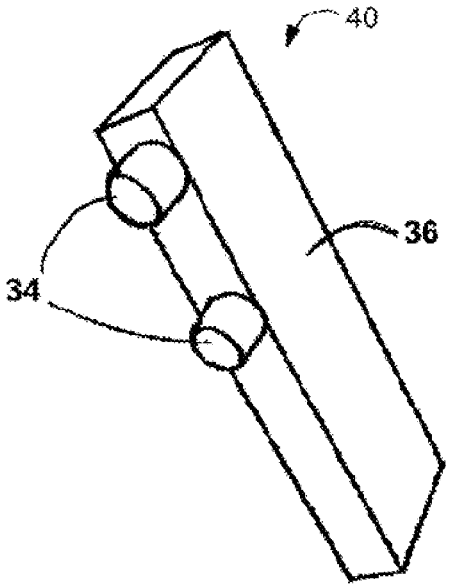
FIG. 7 is a perspective view of a tool for removing the cap 14.

Each cavity 18 and reservoir is additionally capable of accepting a marking agent containing vessel, such as a pouch 38 (FIG. 6) having a pouch top 30 and a pouch body 32, by which marking agent may be introduced into the cavity 18 and/or reservoir. Marking agent may also be introduced into a cavity 18 or reservoir by means of a syringe.

In alternative embodiments the marking agent may comprise flour, chalk, paint, calcium carbonate, calcium sulfate, Epsom salts, sand, liquid marking agents and another composition of matter suitable for marking an object when it comes into contact with the object.

Although some embodiments of the present invention are illustrated as a discus 12, a shot put 20, and a javelin 26, it should be known by those skilled in the art that the inventive system may be implemented on many other thrown objects, competitively thrown or otherwise.

The present invention may be embodied in other specific forms without departing from its spirit or essential characteristics. The above described embodiments are to be considered in all respects only as illustrative, and not restrictive and the scope of the invention.

I claim:

1. A marking discus comprising:

a discus body;

the discus body having at least one cavity within the discuss body;

the discus further having at least one cap portion, and a marking agent disposed inside the at least one cavity wherein;

the at least one cavity is in external communication with the periphery of the body whereby;

the at least one cap portion permits transfer of the marking agent from within the at least one cavity to a space external to a rim or the body of the discus and to a top or a bottom surface of the discus upon impact of the marking discus with another object.

2. The marking discus of claim 1 wherein the cap portion is removable.

3. The marking discus of claim 1 wherein the cap portion comprises a threaded portion.

4. The marking discus of claim 1 wherein the cap portion comprises a screen.

5. The marking discus of claim 1 wherein the marking agent is a substance selected from a group consisting of at least one of flour, chalk, paint, calcium carbonate, calcium sulfate, Epsom salts and sand.

6. A marking shot put comprising:

a shot put body;

the shot put body having at least one cavity within the shot put body;

the shot put body further having at least one cap portion and a marking agent disposed inside the at least one cavity wherein;

the at least one cavity is in external communication with the periphery of the body whereby;

the at least one cap portion permits transfer of the marking agent from within the at least one cavity to a space external to a rim or the body of the shot put and to a top or a bottom surface of the discuss upon impact of the marking discuss with another object.

7. The marking shot put of claim 6 wherein the cap portion is removable.

8. The marking shot put of claim 6 wherein the cap portion comprises a threaded portion.

9. The marking shot put of claim 6 wherein the cap portion comprises a screen.

10. The marking shot put of claim 6 wherein the marking agent is a substance selected from a group consisting of at least one of flour, chalk, paint, calcium carbonate, calcium sulfate, Epsom salts and sand.

11. A javelin comprising:

a javelin body;

the javelin body having at least one cavity within the javelin body;

the javelin body further having at least one cap portion and a marking agent disposed inside the at least one cavity wherein;

the at least one cavity is in external communication with the periphery of the body whereby;

the at least one cap portion permits transfer of the marking agent from within the at least one cavity to a space external to a rim or the body of the javelin and to a top or a bottom surface of the discuss upon impact of the marking discuss with another object.

12. The marking javelin of claim 11 wherein the cap portion is removable.

13. The marking javelin of claim 11 wherein the cap portion comprises a threaded portion.

14. The marking javelin of claim 11 wherein the cap portion comprises a screen.

15. The marking javelin of claim 11 wherein the marking agent is a substance selected from a group consisting of at least one of flour, chalk, paint, calcium carbonate, calcium sulfate, Epsom salts and sand.

* * * * *